US008789565B1

(12) United States Patent
Wicken

(10) Patent No.: US 8,789,565 B1
(45) Date of Patent: Jul. 29, 2014

(54) AIR MANIFOLD ATTACHED TO A PLURALITY OF BALLOONS FOR INFLATING AND DEFLATING A BALLOON CLUSTER USED IN DECORATIVE SHOWROOM AND PARTY DISPLAYS

(75) Inventor: Chris J. Wicken, Denver, CO (US)

(73) Assignee: Balloon Innovations, LLC, Littleton, CO (US)

( * ) Notice: Subject to any disclaimer, the term of this patent is extended or adjusted under 35 U.S.C. 154(b) by 278 days.

(21) Appl. No.: 13/135,170

(22) Filed: Jun. 27, 2011

Related U.S. Application Data

(60) Provisional application No. 61/399,803, filed on Jul. 19, 2010.

(51) Int. Cl.
*B65B 37/00* (2006.01)

(52) U.S. Cl.
USPC ..... 141/237; 141/99; 141/313; 446/221

(58) Field of Classification Search
USPC ..... 446/220, 221, 222; 141/99, 114, 234, 141/236, 237, 313
See application file for complete search history.

(56) References Cited

U.S. PATENT DOCUMENTS

| | | | | |
|---|---|---|---|---|
| 262,517 | A * | 8/1882 | Hendrie | 446/220 |
| 5,127,867 | A * | 7/1992 | Lau | 446/221 |
| 5,234,726 | A * | 8/1993 | Dahan | 428/9 |
| 5,873,764 | A * | 2/1999 | Scherr | 446/220 |
| 6,176,758 | B1 * | 1/2001 | Wu | 446/224 |
| 6,478,057 | B1 * | 11/2002 | Bearss et al. | 141/313 |
| 6,478,651 | B1 * | 11/2002 | Weir | 446/220 |
| 2008/0121309 | A1 * | 5/2008 | Boise et al. | 141/313 |

* cited by examiner

*Primary Examiner* — Jason K Niesz
(74) *Attorney, Agent, or Firm* — Santangelo Law Offices

(57) ABSTRACT

An air manifold adapted for attaching to an air fill opening in a side of plastic, polymer balloons and receiving compressed air therein. The air manifold includes a hollow manifold body with a plurality of outwardly extending manifold air ports attached to and spaced around an outer circumference of the manifold body. The air ports are adapted for releasable or permanent attachment to the air fill openings in the side of the balloons. The manifold body also includes an air tube. The air tube has one end attached to and in fluid communication with the manifold body. An opposite end of the air tube is adapted for receiving the compressed air therethrough and into the manifold body. When the compressed air is received through the air tube and into the manifold body, the balloons attached to the manifold air ports are inflated for forming a balloon cluster around the manifold body thus providing an attractive and decorative display.

10 Claims, 2 Drawing Sheets

AIR MANIFOLD ATTACHED TO A PLURALITY OF BALLOONS FOR INFLATING AND DEFLATING A BALLOON CLUSTER USED IN DECORATIVE SHOWROOM AND PARTY DISPLAYS

This non-provisional, utility patent application claims the benefit of an earlier filed provisional application Ser. No. 61/399,803, filed on Jul. 19, 2010, by the subject inventor, and having the same title.

BACKGROUND OF THE INVENTION (a) Field of the Invention

This invention relates to showroom and party balloon displays and the filling of balloons and more particularly, but not by way of limitation, to a balloon cluster of plastic polymer balloons joined together using a center air manifold. The air manifold used to inflate and deflate the cluster of balloons held tightly together in a decorative display.

(b) Discussion of Prior Art

Heretofore in the display of decorative balloons, the balloons are inflated individually and then held together using string, cord and like securing devices. The inflating and securing of the individual balloons into a cluster is time consuming and requires time and expense in replacing punctured and deflated balloons.

Balloons made of Mylar or foil tend to expand with an increase in temperature and pop, while the balloons wrinkle and sag with a decrease in temperature. Also, Mylar balloons are created by pressing together two sheets of material and therefore the balloons have an unattractive and visible seam. Further, Mylar balloons don't have a perfectly round or oval shape, as used in the subject invention. Therefore, these type of balloons can't be held in a tight, symmetrical cluster as shown in the drawings of this application.

Latex balloons become oxidized by sunlight and air flow and become chalky in appearance and/or become deflated over a period of time. Also, latex balloons are prone to degradation over time making them smaller and misshaped. Further, these type of balloons are less durable, when compared to a balloon make of plastic polymer, and are easily punctured and have to be replaced.

In U.S. Pat. No. 4,701,148 to Cotey, U.S. Pat. Nos. 4,167,204 and 3,994,324 to Zeyra, different types of valves and apparatus are described for inflating party balloons. Also, U.S. Pat. No. 6,782,675 to Banks et al. describes a system for packaging and distributing balloons in a hydrated state.

None of the above mentioned prior art patents describe the unique structure, function and advantages of the subject air manifold used for inflating and deflating a plurality of round or oblong, sphere-shaped, plastic polymer balloons used in a decorative balloon cluster.

SUMMARY OF THE INVENTION

In view of the foregoing, it is a primary objective of the subject invention to provide an easy, inexpensive and quick way to inflate a plurality of balloons at the same time. The balloons are held in a symmetric, color coordinated, tight cluster next to each other and hung or suspended from a ceiling, wall, a balloon stand and the like.

Another object of the invention is the balloon cluster can also be quickly deflated for ease in transporting and storage and at a later date inflated again having the same symmetric and color coordinated balloon cluster. Also, the balloons can be quickly disconnected from the air manifold in case of a needed replacement of one or more balloon failures or to change out certain balloon colors. The balloon cluster can be used time and again without the added expense of replacing individual deflated balloons or punctured balloons. The balloon cluster can be used for showroom, party rooms and various other indoor and outdoor areas having balloon displays.

Still another object of the invention is the balloon cluster uses plastic polymer balloons. Using this type of balloon material, the balloon is formed into a round, oblong, or other annular shapes for an attractive appearance. The balloons can be filled with air rather than helium and are not subject to or only slight temperature fluctuations, therefore reducing the cost of replacing balloons that are punctured or pop or become wrinkled and sag over a period of time.

The air manifold is adapted for attaching to an air fill opening in a side of plastic, polymer balloons and receiving compressed air therein. The air manifold includes a hollow manifold body with a plurality of outwardly extending manifold air ports attached to and spaced around an outer circumference of the manifold body. The air ports are adapted for releasable attachment to the air fill openings in the side of the balloons. The manifold body also includes an air tube. The air tube has one end attached to and in fluid communication with the manifold body. An opposite end of the air tube is adapted for receiving the compressed air therethrough and into the manifold body. When the compressed air is received through the air tube and into the manifold body, the balloons attached to the manifold air ports are inflated for forming a balloon cluster around the manifold body thus providing an attractive and decorative display.

These and other objects of the present invention will become apparent to those familiar with balloon displays and the use of a cluster of balloons secured together when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of various types of balloon displays, and in which.

DETAILED DESCRIPTION OF THE PREFERRED EMBODIMENTS

Figure 1:
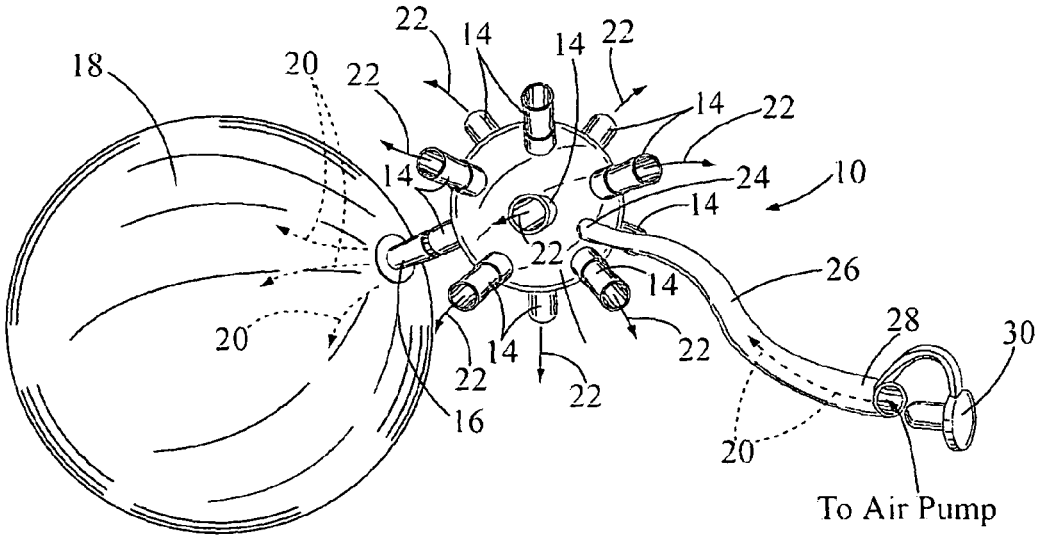
FIG. 1 is a perspective view of the subject air manifold with a manifold air port attached to an inflated balloon.

In FIG. 1, a perspective view of one embodiment of the subject invention is illustrated with the balloon center air manifold having a general reference numeral 10. The air manifold 10 has a round, hollow manifold body 12 for receiving air therein and discharging the air outwardly through a plurality of outwardly extending manifold air ports 14. The air ports can be equally spaced around an outer circumference of the hollow body 12 and include, in a range of 4 to 12 or more air ports.

The manifold air ports 14 can be releaseably attached or permanently attached to air fill openings 16 in a side of plastic polymer balloons 18. Only one balloon 18 is shown in this drawing and with dashed arrows 20 illustrating air received inside the balloon for inflating the balloon. Also, solid arrows 22 are shown exiting the manifold air ports 14 for inflating additional balloons 18, when attached to the hollow body 12.

In this embodiment of the balloon air manifold 10, one end 24 of an air tube 26 is attached to an opening in the hollow manifold body 12. An opposite end 28 of the air tube 26 is adapted for attaching to an air pump, or other means for air inflation, for inflating the balloons 18 using the manifold 10. The air pump isn't shown in the drawings. The opposite end 28 of the air tube 26 includes an air tube cap 30. The air tube cap 30 is used for sealing the compressed air inside the balloons 18 and the manifold body 12, when they are completely inflated. Obviously, when the air tube cap 30 is removed from the opposite end 26 of the air tube 26, the balloons can be quickly deflated for storage. Also and as an option, the one end 24 of the air tube 26 can be attached to one of the manifold air ports 14 and then removed, when the balloons 18 are inflated and the air tube cap 30 placed on top of the air port.

Figure 2:
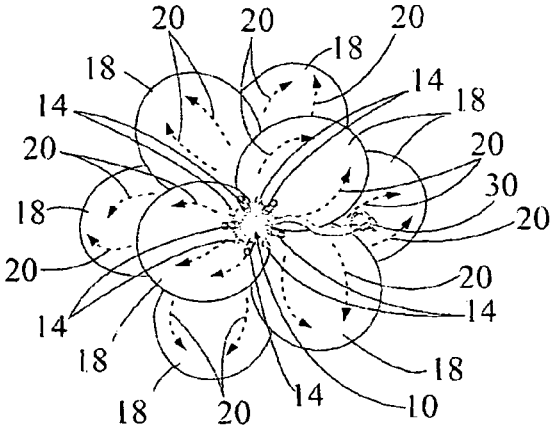
FIG. 2 is a perspective view of the air manifold with a complete cluster of inflated balloons attached to and surround the air manifold.

In FIG. 2, a perspective view of a symmetrical, color-coordinated, balloon cluster is illustrated and having general reference numeral 32. In this view and as an example, a total of twelve balloons have been inflated all at the same time and using the subject balloon manifold 10. In this drawing, nine of the balloon can be seen, while the other three balloons are hidden in the back of the balloon cluster 32. While twelve balloons are discussed herein, it should be kept in mind that any number of balloons 18 can be used equally well with the balloon air manifold 10 and inflated into a balloon cluster 32.

It should be mentioned that using the balloon manifold 10, the balloons 18 can be easily color-coordinated. For example, two red balloons can be placed next to each other and next to a pair of white balloons and next to a pair of blue balloons. With the balloons staying attached to the air ports 14 and when the cluster 32 is deflated, the cluster can be re-inflated and the colored balloons returned to their coordinated color scheme.

Figure 3:
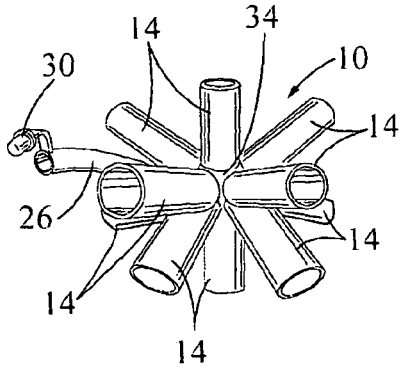
FIG. 3 is a perspective view of a smaller, central manifold with a plurality of manifold air ports extending outwardly from the small manifold.

In FIG. 3, a perspective view of the air manifold 10 is shown and without the use of a round hollow body 12, as shown in FIGS. 1 and 2. In this embodiment, the air manifold 10 merely has a small, central manifold opening 34 connected to each of the manifold air ports 14 used for filling the balloons. The central manifold opening 34 is shown connected to the air tube 26 with air cap 30.

Figure 4:
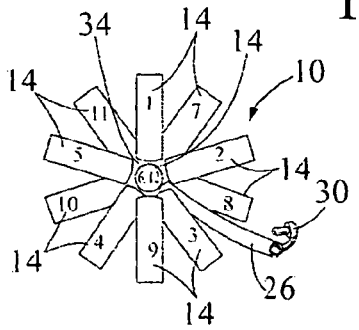
FIG. 4 is similar to FIG. 3 and illustrates the manifold air ports numbered 1 through 12.

In FIG. 4, another perspective view of the air manifold 10 is shown and similar to the manifold shown in FIG. 3. In this drawing, the air ports 14 have been number 1 through 12 for connecting to the air fill openings 16 of twelve different balloons 18. As mentioned above, there may be 4 to 12 or more air ports 14. In this drawing and for example, the air ports numbered 1 to 4 can be attached to red balloons, air ports numbered 5 to 8 can be attached to white balloons and air ports 9-12 can be attached to blue blues for a "Red, White and Blue" balloon cluster. Obviously, there can be any number of combinations of different colored balloons attached to the air ports for an attractive balloon display.

Figure 5:
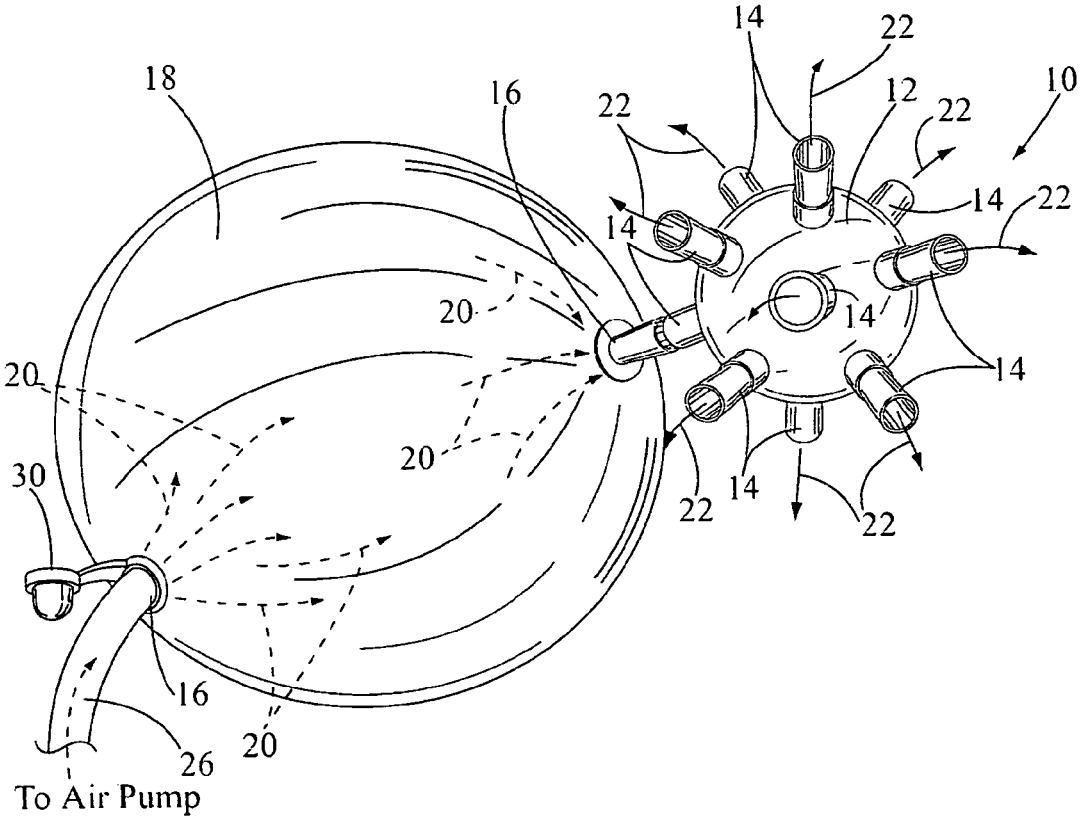
FIG. 5 is an alternate embodiment of the air manifold wherein one of the balloons is used to direct pressurized air to the manifold for inflating the balloons attached thereto.

In FIG. 5, another embodiment of the subject invention is shown wherein the air tube 26 is connected to a first fill opening 16 in one side of a first balloon 18, rather than connected directly to the hollow body 12, as shown in FIGS. 1 and 2. In the opposite side of the first balloon 18 is a second air fill opening 16 for receiving air through the balloon and into the air manifold 10 for filling the other balloons as indicated by arrows 22. Therefore and using the air tube 26 connected to an air pump, the first balloon 18 initially receives compressed air from the air tube 26. Air then exits the second air fill opening 16, through the body 12 of the air manifold 10 and through the other air ports 14 for filling the other balloons. The balloon cluster 32 can be deflated by merely opening the air tube cap 30 and allowing the air to escape through the series of air fill openings 16.

Figure 6:
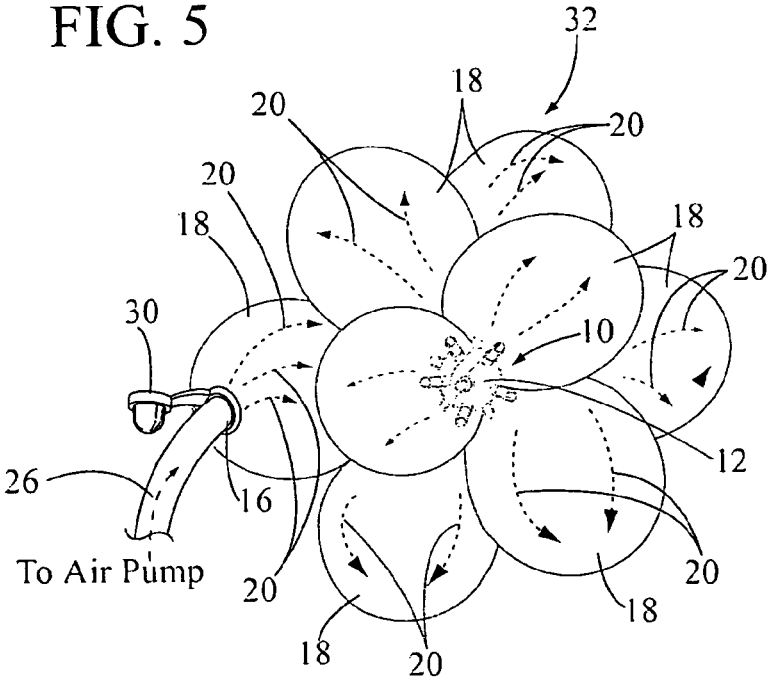
FIG. 6 illustrates the use of the alternate embodiment shown in FIG. 5 and with all of the balloons inflated for forming a balloon cluster.

In FIG. 6, another perspective view of the balloon cluster 32 is shown and similar to FIG. 2. In this example, the air tube 26 is connected to the first balloon 18, as shown in FIG. 5, and the balloons are filled with compressed air received through the first balloon rather than the air tube connected directly to the hollow body 12, as shown in FIGS. 1 and 2.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

What is claimed is:

1. A non-resilient plastic balloon air manifold comprising:

a non-resilient plastic hollow manifold body having a substantially sphere-like geometric configuration;

a plurality of opposing non-resilient plastic manifold air ports attached to an outer circumference of said manifold body wherein said air ports extend outwardly from a central axis point inside said manifold body and are further adapted for attachment to non-resilient plastic air fill opening integrally positioned in at least one plastic polymer balloon; and whereby said non-resilient plastic air fill openings are adapted to attach to at least one of said non-resilient plastic manifold air ports through a sheer attachment;

at least one air tube in fluid communication with said manifold body and further adapted to receive air through and into said manifold body; and whereby when said air is received through said air tube and into the manifold body, said plastic polymer balloon attached to said manifold air port is inflated.

2. The non-resilient plastic air manifold as described in claim 1 wherein said air tube includes at least one air tube cap.

3. The non-resilient plastic air manifold as described in claim 1 wherein said non-resilient plastic air ports comprise a plurality of non-resilient plastic air ports substantially equally spaced around said circumference of said manifold body.

4. The non-resilient plastic air manifold as described in claim 3 wherein said plurality of non-resilient plastic air ports is in a range of 2 to 12 air ports or more.

5. A combination air manifold and balloon cluster for receiving air comprising:

a non-resilient plastic hollow manifold body;

a plurality of outwardly extending non-resilient plastic manifold air ports attached to an outer circumference of the manifold body wherein said air ports extend outwardly from a central point inside said manifold body;

a plurality of plastic polymer balloons having at least one integral non-resilient plastic air fill openings in the side of said balloon wherein said non-resilient plastic air fill opening is adapted to attach to at least one of said integral non-resilient plastic manifold air ports; and an air tube having one end attached to at least one additional non-resilient plastic air fill opening integrally positioned in a side on a selected plastic polymer balloon, the selected balloon being in fluid communication with the manifold body, and an opposite end adapted to receive air there through and into said manifold body; and whereby when said air is received through said additional integrally positioned non-resilient plastic air fill opening in the side of at least one selected balloon, the manifold body receives air therein for inflating the balloons and forming a balloon cluster around the manifold body for a decorative display.

6. The combination air manifold and balloon cluster for receiving air as described in claim 5 wherein said plastic polymer balloon includes an integral air cap.

7. The combination air manifold and balloon cluster for receiving air as described in claim 5 wherein said non-resilient plastic air ports are substantially equally spaced around said circumference of said manifold body.

8. The combination air manifold and balloon cluster for receiving air as described in claim 5 wherein the plurality of non-resilient plastic air ports is in a range of 2 to 12 air ports or more.

9. The combination air manifold and balloon cluster for receiving air as described in claim 1 wherein said non-resilient plastic air fill opening of at least one balloon comprises an air fill opening integrally positioned in the side of a balloon.

10. The combination air manifold and balloon cluster for receiving air as described in claim 5 wherein said non-resilient plastic air fill opening is adapted to attach to at least one of said non-resilient plastic manifold air ports through a sheer attachment.

* * * * *